US005472520A

United States Patent [19]

Anabuki et al.

[11] Patent Number: 5,472,520

[45] Date of Patent: Dec. 5, 1995

[54] METHOD OF CONTROLLING OXYGEN DEPOSITION DURING DECARBUTIZATION ANNEALING ON STEEL SHEETS

[75] Inventors: Yoshinori Anabuki; Kazuo Kawamura; Yutaka Kosaka; Hirotake Ishitobi; Michio Komatsubara, all of Okayama, Japan

[73] Assignee: Kawasaki Steel Corporation, Japan

[21] Appl. No.: 358,415

[22] Filed: Dec. 19, 1994

[30] Foreign Application Priority Data

| | | | |
|---|---|---|---|
| Dec. 24, 1993 | [JP] | Japan | 5-327280 |
| Dec. 24, 1993 | [JP] | Japan | 5-327281 |
| Dec. 24, 1993 | [JP] | Japan | 5-327282 |

[51] Int. Cl.[6] ..... C21D 8/12

[52] U.S. Cl. ..... 148/216; 148/241

[58] Field of Search ..... 148/215, 216, 148/217, 241, 111, 629

[56] References Cited

U.S. PATENT DOCUMENTS

| | | | |
|---|---|---|---|
| 5,127,971 | 7/1992 | Komatsubara et al. | 148/111 |
| 5,269,853 | 12/1993 | Komatsubara et al. | 148/111 |

*Primary Examiner*—Deborah Yee
*Attorney, Agent, or Firm*—Austin R. Miller

[57] ABSTRACT

A method for controlling oxygen deposition on steel sheets. The oxygen deposition value of a steel sheet measured after decarburization annealing remains at a constant value by controlling, in the decarburization annealing line for the steel sheet, the electrolytic electricity density in electrolytic degreasing equipment included in the decarburization annealing line.

12 Claims, 5 Drawing Sheets

| OPERATION NO. | OPERATION (1) | | OPERATION (2) | |
|---|---|---|---|---|
| LINE SPEED AT COLD ROLLING (mpm) | 100 | 1000 | 100 | 1000 |
| SURFACE ROUGHNESS AFTER ROLLING Ra(μm) | 0.20 | 0.35 | 0.20 | 0.35 |

METHOD OF CONTROLLING OXYGEN DEPOSITION DURING DECARBUTIZATION ANNEALING ON STEEL SHEETS

BACKGROUND OF THE INVENTION

1. Field of the Invention

The present invention relates to a method of controlling oxygen deposition in decarburization annealing lines on anisotropic electromagnetic steel sheets, and more particularly relates to a method for precisely applying a target oxygen deposition value to a steel sheet.

2. Description of the Related Art

The purpose of a decarburization annealing process for anisotropic electromagnetic steel sheets is to decarburize steel sheets to prevent magnetic aging of final products, and also form an oxide film (mainly consisting of $SiO_2$ and $Fe_2SiO_4$) necessary for producing a vitreous film during finish annealing that is then conducted under application of an annealing separation agent. Oxide film greatly influences the behavior of secondary recrystallization during final annealing. Hence, oxide film affects magnetic characteristics of the final product and greatly influences the quality of the vitreous film formed on the surface of the final product. Therefore, the amount of oxide film produced must be strictly controlled.

Oxygen deposition is usually employed as a component of the total amount of the oxide film produced. Several methods for properly controlling oxygen deposition have heretofore been proposed. For example, Japanese Patent Laid-Open No. 3-122221 proposes a method by which components of atmospheric gas on the delivery side of a decarburization annealing furnace are compared with those on the supply side, and the amount of $H_2O$ in the supply gas is changed in accordance with the measured difference. Also, Japanese Patent Laid-Open No. 4-337003 proposes a method by which an estimated value of oxygen deposition is determined in a regression manner based on the dew point in an annealing furnace, the sheet temperature and the soaking time, then the dew point of atmospheric gas is changed so that the estimated value coincides with a target value.

The above-described prior art methods, however, require monitoring either atmospheric gas or sheet temperature to maintain oxygen deposition at a predetermined value, which creates response lags lasting several tens of minutes or more. Accordingly, none of the prior art methods provide a quick system response necessary to maintain constant oxygen deposition during abrupt changes in the surface roughness of the steel sheet, variations in cold rolling conditions of the preceding step, etc. Additionally, long lag times exist in the prior art between implementation of corrective measures and re-establishment of the target oxygen deposition value.

SUMMARY OF THE INVENTION

With a view to solving the problems described above, an object of the present invention is to provide a method of maintaining constant oxygen deposition onto a steel sheet during decarburization annealing when abrupt changes in surface roughness of a steel sheet are not present by using, as a parameter for controlling oxygen deposition, the electrolytic electricity density (also sometimes referred to hereinafter as "current density") in electrolytic degreasing equipment (also sometimes referred to hereinafter as "electrolytic degreasers" and "electrolytic cleaners") upstream of a decarburization annealing furnace. The present invention provides superior system responsiveness over prior art methods such as atmospheric gas or sheet temperature monitoring in decarburization annealing furnaces.

The present invention provides a method of oxygen deposition control in which the electrolytic electricity density in electrolytic degreasing equipment is adjusted to maintain a constant oxygen deposition value or amount on an anisotropic electromagnetic steel sheet, the value being measured after decarburization annealing.

Also, the present invention provides a method of oxygen deposition control in which a set value Is of the electrolytic electricity density in electrolytic degreasing equipment corresponding to a particular position in the longitudinal direction of an anisotropic electromagnetic steel sheet to be processed is determined from rolling conditions such as the rolling speed, the kind of rolling oil, the type of rolling rolls and the like, which affect the surface roughness Ra of the anisotropic electromagnetic steel sheet. In a cold rolling step prior to decarburization annealing of the steel sheet, the set value Is is corrected based on an electrolytic electricity density correction value ΔIs which is calculated from an actual value of the oxygen deposition continuously measured by an oxygen deposition measuring device. While tracking the steel sheet under treatment in the electrolytic degreasing equipment before decarburization annealing, the electrolytic degreasing equipment is operated in accordance with a corrected set value I of the electrolytic electricity density corresponding to the particular position in the longitudinal direction of the steel sheet, and the steel sheet is then subject to the decarburization annealing, whereby oxygen deposition onto the anisotropic electromagnetic steel sheet during decarburization annealing remains constant.

Further, the present invention provides a method of oxygen deposition control in which the surface roughness Ra of an anisotropic electromagnetic steel sheet to be processed at a particular position in the longitudinal direction thereof is estimated from rolling conditions such as the rolling speed, the kind of rolling oil, the type of rolling rolls and the like, which affect the surface roughness Ra of the anisotropic electromagnetic steel sheet, in a cold rolling step prior to decarburization annealing of the steel sheet. Electrolytic degreasing equipment provided in the decarburization annealing line for anisotropic electromagnetic steel sheets is operated in accordance with an electrolytic electricity density corresponding to the estimated surface roughness Ra of the steel sheet at the particular position in the longitudinal direction of the steel sheet. The steel sheet is then subject to decarburization annealing, whereby oxygen deposition onto the anisotropic electromagnetic steel sheet measured after decarburization annealing remains constant.

Moreover, the present invention provides an oxygen deposition control method in which the surface roughness Ra at a particular position in the longitudinal direction of an anisotropic electromagnetic steel sheet is measured by a surface roughness meter in the decarburization annealing line. Electrolytic degreasing equipment is operated in accordance with an electrolytic electricity density corresponding to the measured surface roughness Ra of the steel sheet at the particular position in the longitudinal direction of the steel sheet. The steel sheet is then subject to decarburization annealing, whereby oxygen deposition onto the anisotropic electromagnetic steel sheet measured after the decarburization annealing remains constant.

We have discovered that when the electrolytic electricity density in electrolytic degreasing equipment was set to 0

C/dm$^2$, 5 C/dm$^2$ and 10 C/dm$^2$ under constant annealing conditions, there was strong positive correlation between the surface roughness and oxygen deposition after decarburization annealing, as shown in FIG. 1. Thus, oxygen deposition during decarburization annealing can be controlled by changing the electrolytic electricity density in the electrolytic degreasing equipment. This discovery has resulted in the creation of the present invention.

In the present invention, because controlling oxygen deposition by adjusting the electrolytic electricity density in electrolytic degreasing equipment enables a quick system response, the oxygen deposition (or the amount of oxygen deposited) during decarburization annealing can be precisely maintained at the target value even when the surface roughness of a steel sheet varies.

Oxygen deposition can be determined by sampling a steel sheet of a predetermined area and carrying out chemical analysis on the sampled sheet. In this case, the oxygen deposition on each side of the sheet equals ½ of the value indicated in FIG. 1.

DETAILED DESCRIPTION OF THE PREFERRED EMBODIMENTS

Embodiments of the present invention will hereinafter be described in detail with reference to specific forms of the invention, but specific terms used in the specification are not intended to limit the scope of the invention which is defined in the appended claims.

[Embodiment 1]

Figure 1:
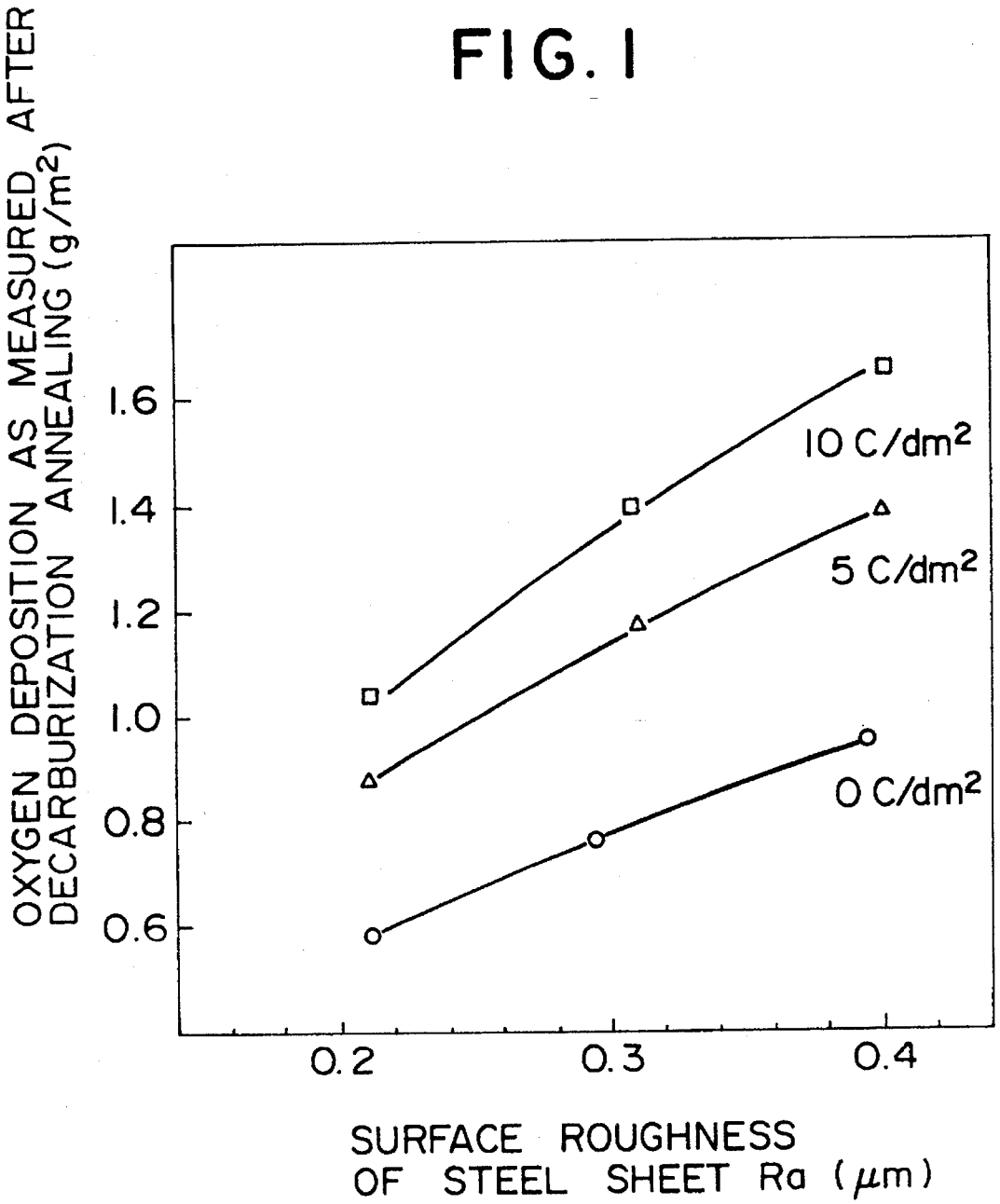
FIG. 1 is a graph showing the relationship between the surface roughness of a steel sheet and oxygen deposition measured after decarburization annealing resulting when electrolytic electricity density in electrolytic degreasing equipment is varied.
Figure 2:
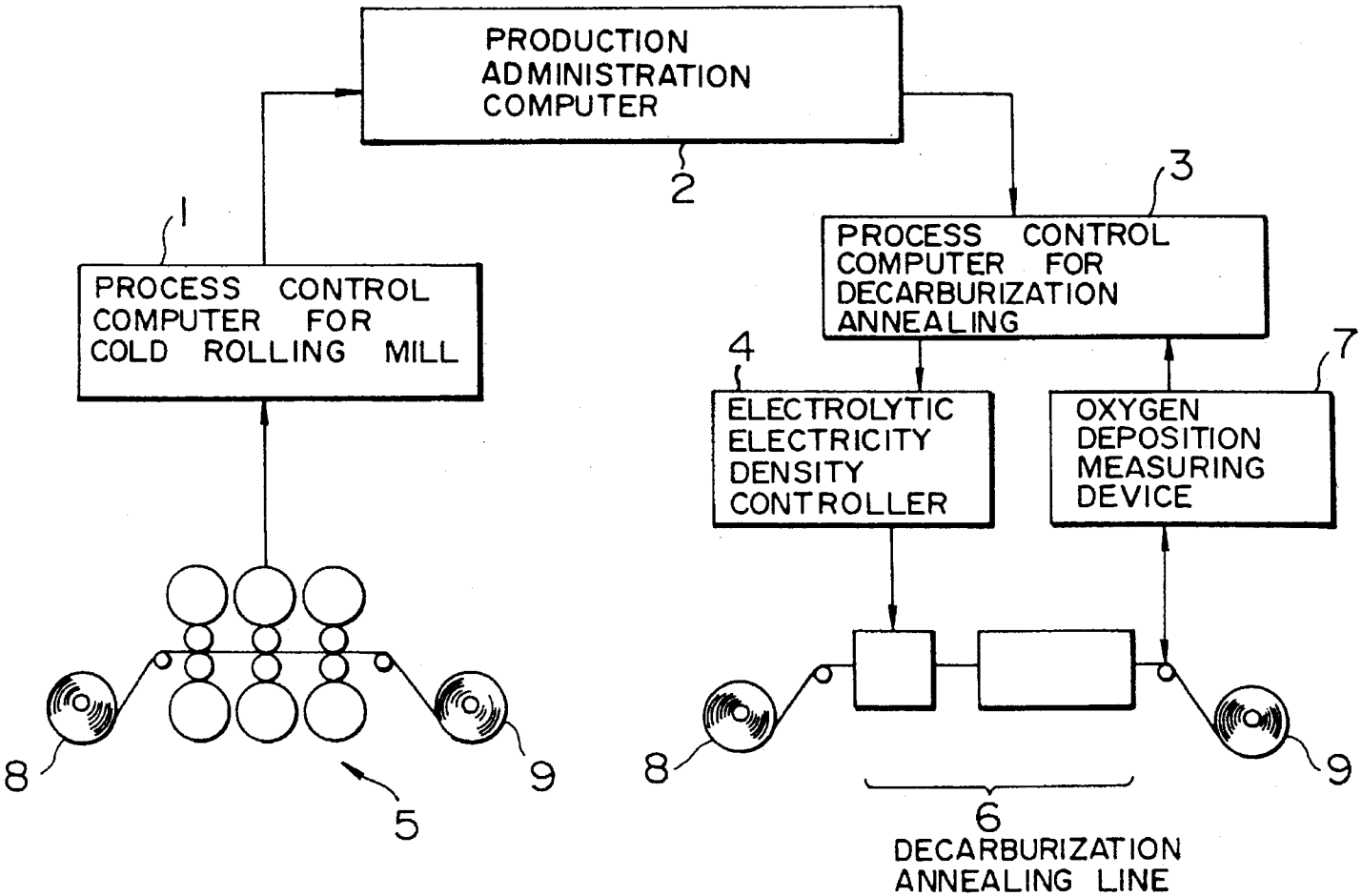
FIG. 2 is a schematic diagram of selected parts of a production line in combination with a block diagram of an apparatus to control oxygen deposition in accordance with this invention.

A diagram of one embodiment of the present invention is shown in FIG. 2.

In FIG. 2, a process control computer 1 of a type known in the art for cold rolling mill 5 collects rolling conditions data such as average rolling speed, type of rolling oil, type of rolling rolls, rolling length, type of steel sheet, sheet thickness and sheet width, which affect the surface roughness Ra (μm) of the steel sheet. A predetermined pitch, e.g., 10 m, in the longitudinal direction of the steel sheet under rolling is used. Process control computer 1 then transmits the collected information to a production administration computer 2 for each steel sheet rolled.

The production administration computer 2 determines a set value Is of the electrolytic electricity density at the predetermined pitch of, for example, 10 m in the longitudinal direction of the steel sheet from the transmitted rolling conditions data in accordance with Equation (1) below, and then transmits the determined value to process control computer 3 associated with decarburization annealing line 6 for each steel sheet subject to decarburization annealing. The following Equation (1) is a formula derived from various rolling experiments.

$$IS=f(V, 0, K, L, S, T, W, Oh) \quad (1)$$

wherein Is represents a set value of electrolytic electricity density at a predetermined pitch, and wherein V=average rolling speed at the predetermined pitch, O=type of rolling oil, K=type of rolling rolls, L=rolling length, S=kind of steel sheet, T=thickness of steel sheet, W=width of steel sheet, and Oh=target value of oxygen deposition.

The process control computer 3 for decarburization annealing line 6 corrects the set value Is of the electrolytic electricity density corresponding to a particular position in the longitudinal direction of the steel sheet based on an electrolytic electricity density correction value ΔIs, calculated from an actual value of the oxygen deposition continuously measured by an oxygen deposition measuring device 7 which is known in the art. While tracking the steel sheet under treatment in the electrolytic degreasing equipment before the decarburization annealing, process control computer 3 transmits the corrected set value I of the electrolytic electricity density to an electrolytic electricity density controller 4 at the predetermined pitch such as at 10 m in the longitudinal direction of the steel sheet, for example.

The electrolytic electricity density correction value ΔIs is determined from, by way of example, the following equation.

$$\Delta IS=G\times(Oh-Oh^*) \quad (2)$$

where

Oh*=actual value of oxygen deposition, and

G=gain.

The electrolytic electricity density controller 4 controls the electrolytic electricity density in accordance with the corrected set value I, given below, in a dynamic manner.

$$I=Is-\Delta Is \quad (3)$$

FIG. 2 also shows payoff reels 8 and tension reels 9.

Figure 3:
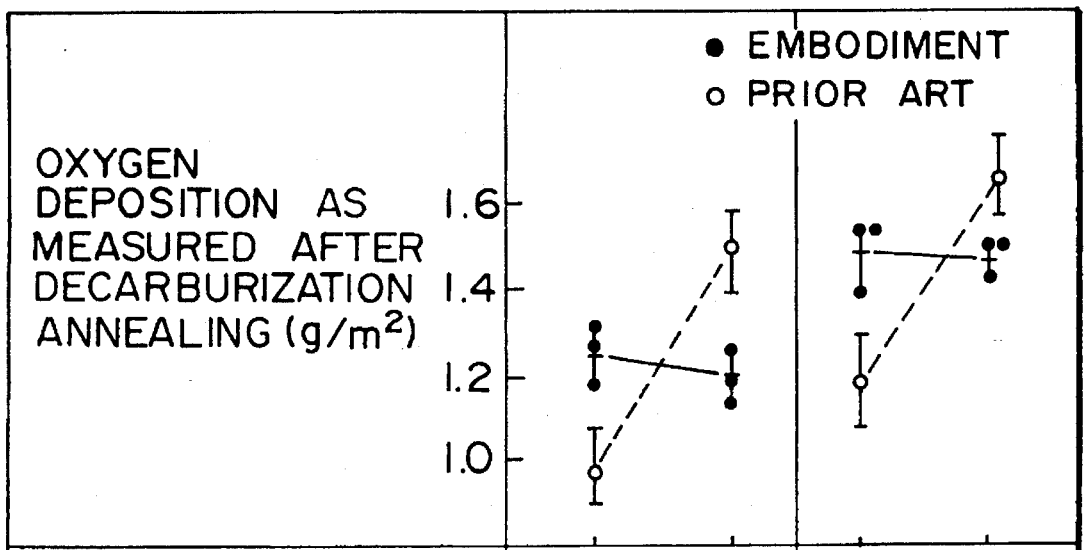
FIG. 3 is a graph comparing the efficacy of prior art methods and the present invention in maintaining constant oxygen deposition under varying operating conditions.

FIG. 3 shows results obtained when the present invention was applied to actual line operations. In the operations, sodium orthosilicate was used as an electrolyte for the electrolytic degreasing equipment.

Operation (1) was carried out on steel strips processed at cold rolling line speeds of 100 mpm and 1000 mpm and having respective surface roughnesses Ra of 0.20 μm and 0.35 μm after rolling, in accordance with the methods of both the present invention and the prior art. The target oxygen deposition (both sides) measured after decarburization annealing was 1.2 g/m$^2$.

In the operation in accordance with the present invention, the electrolytic electricity density was set to 4 C/dm$^2$ for the steel strip having a surface roughness Ra of 0.20 μm, and to 0 C/dm$^2$ for the steel strip having a surface roughness Ra of 0.35 μm. In the operation in accordance with the prior art, the electrolytic electricity density was set to 2 C/dm$^2$ for the steel strips of both tested surface roughnesses Ra of 0.20 μm and 0.35 μm.

The operation (2) was carried out on steel strips processed at cold rolling line speeds of 100 mpm and 1000 mpm and having respective surface roughnesses Ra of 0.20 μm and 0.35 μm after rolling, in accordance with the methods of both the present invention and the prior art. The target oxygen deposition (both sides) measured after decarburization annealing was 1.5 $g/m^2$.

In the operation in accordance with the present invention, the electrolytic electricity density was set to 6 $C/dm^2$ for the steel strip having a surface roughness Ra of 0.20 μm, and to 2 $C/dm^2$ for the steel strip having a surface roughness Ra of 0.35 μm. In the operation in accordance with the prior art, the electrolytic electricity density was set to 4 $C/dm^2$ for the steel strips of both tested surface roughnesses Ra of 0.20 μm and 0.35 μm.

From FIG. 3, it is seen that oxygen deposition varied by more than 0.2 $g/m^2$ in a single coil due to changing surface roughness of the steel sheet and the failure of adequate oxygen deposition control in the prior art method. The present invention controlled oxygen deposition to within a remarkable 0.1 $g/m^2$ of the target value under constant annealing conditions and under controlled electrolytic electricity density. Conversely, the prior art method, also conducted under constant annealing conditions but constant electrolytic electricity density, deviated significantly from the target oxygen deposition value.

[Embodiment 2]

Figure 4:
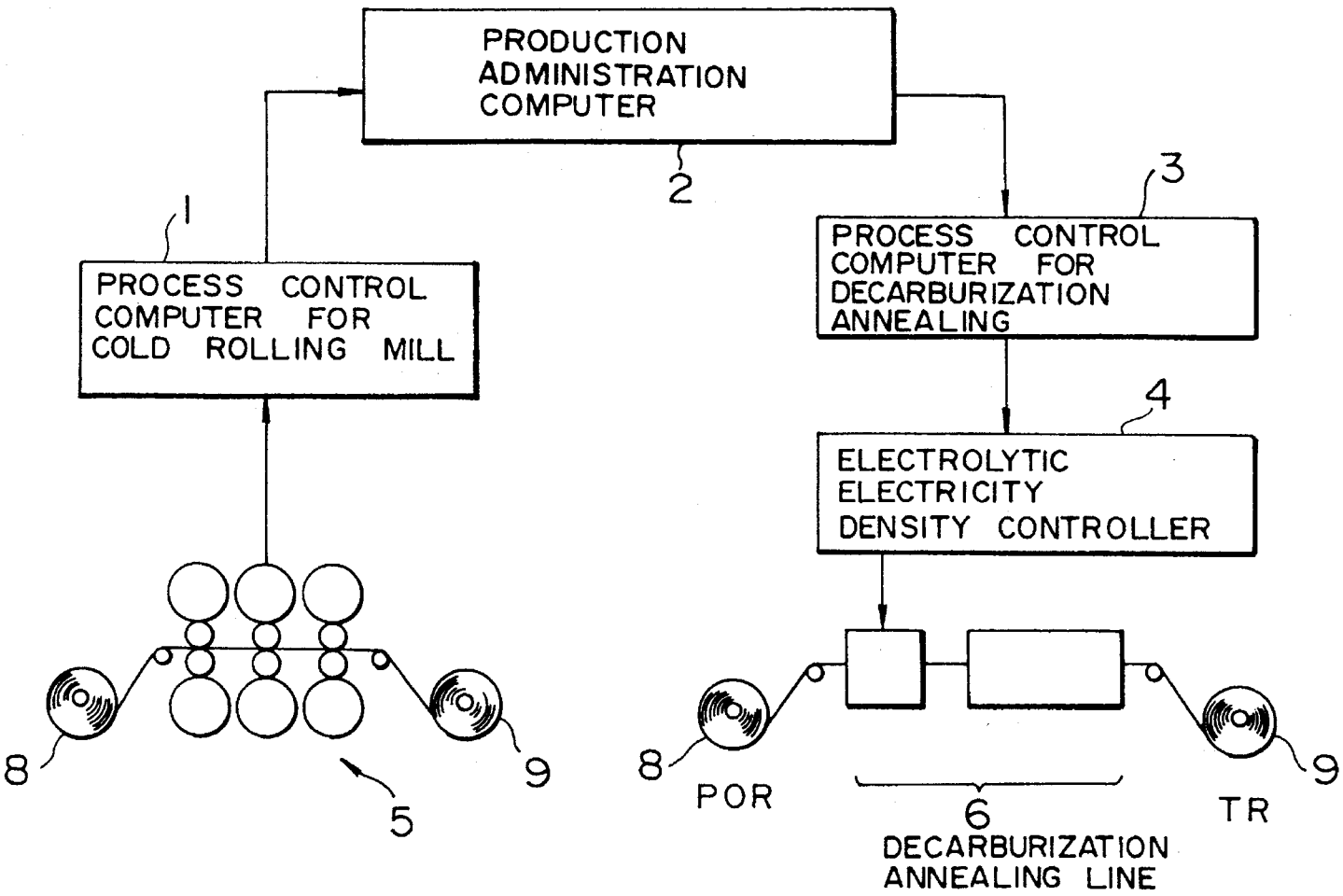
FIG. 4 is a drawing similar to FIG. 1 showing an alternative embodiment of the present invention.

A diagram of another embodiment of the present invention is shown in FIG. 4.

In FIG. 4, process control computer 1 for cold rolling mill 5 collects rolling conditions data such as average rolling speed, type of rolling oil, type of rolling rolls, rolling length and the like which affect the surface roughness Ra of the steel sheet. A predetermined pitch, e.g., 10 m, in the longitudinal direction of the steel sheet under rolling is typically used. Process control computer 1 then transmits the collected information to a production administration computer 2 for each steel sheet rolled.

The production administration computer 2 calculates an estimated value Ra of the surface roughness of the steel sheet at the predetermined pitch of 10 m in the longitudinal direction of the steel sheet, for example, from the transmitted data of rolling conditions in accordance with Equation (4) below.

The following Equation (4) is a formula derived from various rolling experiments.

$$Ra=g(V, 0, K, L, S, T, W) \quad (4)$$

where

V=rolling speed,

O=type of rolling oil,

K=type of rolling rolls,

L=rolling length,

S=kind of steel sheet,

T=thickness of steel sheet, and

W=width of steel sheet.

Additionally, production administration computer 2 determines a set value Is' of the electrolytic electricity density at the predetermined pitch in accordance with Equation (5) below, and then transmits the determined value to process control computer 3 (associated with a decarburization annealing line 6) for each steel sheet subject to decarburization annealing.

The following Equation (5) is a calculation formula derived from actual data.

$$Is'=h\ (Ra, Oh, S, T) \quad (5)$$

where Oh=target value of oxygen deposition.

Process control computer 3 for decarburization annealing line 6 tracks the steel sheet under treatment in the electrolytic degreasing equipment before decarburization annealing, and transmits to electrolytic electricity density controller 4 set value Is' of the electrolytic electricity density corresponding to a particular position in the longitudinal direction of the steel sheet at the predetermined pitch in the same direction. Electrolytic electricity density controller 4 controls the electrolytic electricity density in accordance with the received set value in a dynamic manner.

FIG. 4 also shows payoff reels 8 and tension reels 9.

[Embodiment 3]

Figure 5:
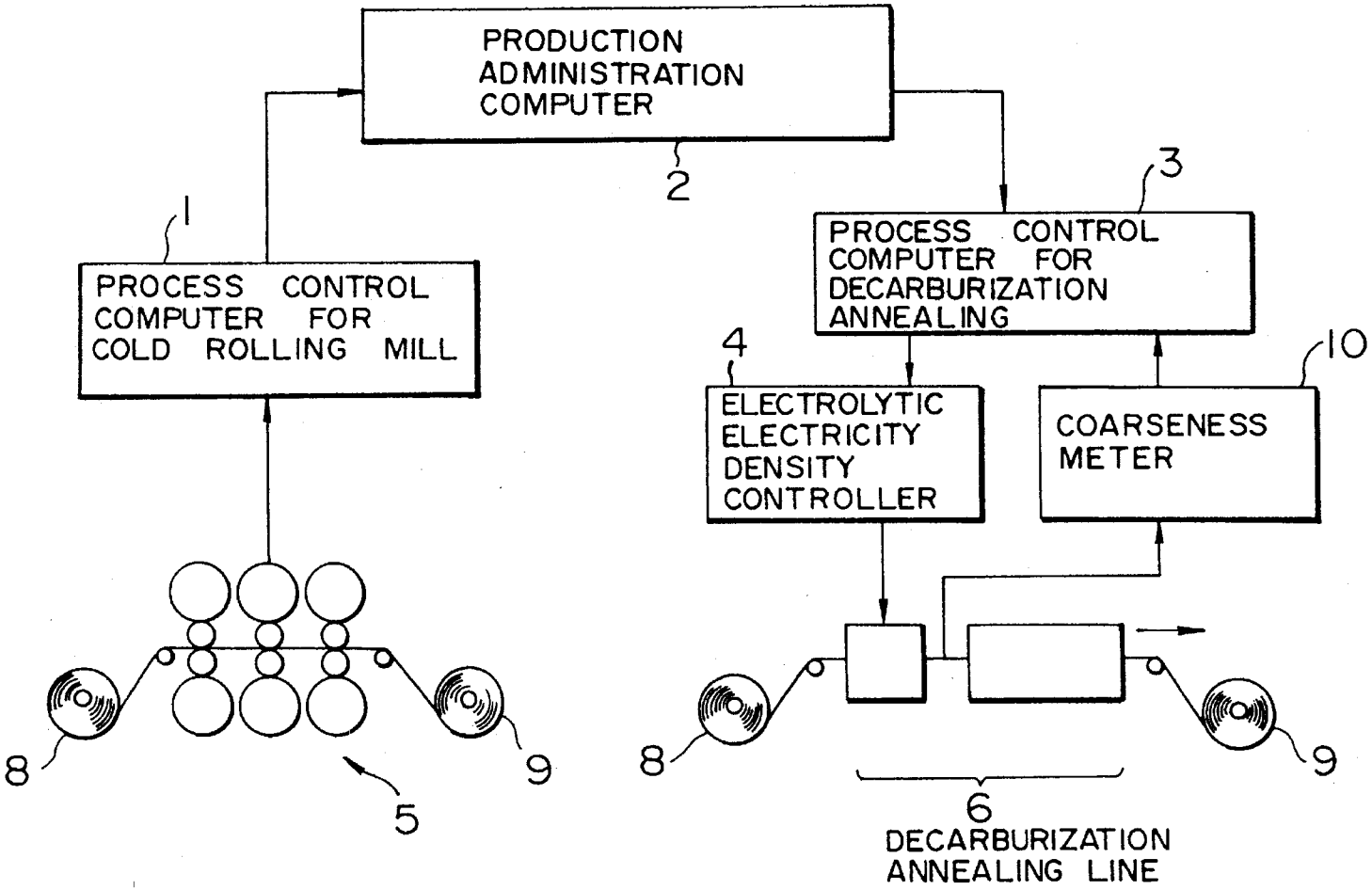
FIG. 5 is a drawing similar to FIGS. 2 and 4 showing still another alternative embodiment of the present invention.

A diagram of still another embodiment of the present invention is shown in FIG. 5.

In FIG. 5, the surface roughness Ra of a steel sheet is directly measured by surface roughness meter 10, and the measured value is transmitted to process control computer 3 for decarburization annealing line 6. Then, process control computer 3 tracks the steel sheet under treatment in electrolytic degreasing equipment before decarburization annealing, and transmits to electrolytic electricity density controller 4 a set value Is' of the electrolytic electricity density which corresponds to a particular position in the longitudinal direction of the steel sheet and is calculated from the measured surface roughness of the steel sheet. Electrolytic electricity density controller 4 controls the electrolytic electricity density in accordance with the received set value in a dynamic manner.

Direct optical measurement of surface roughness of the steel sheet may be readily performed through utilization of laser beam reflection methods, for example.

Applying the methods of Embodiments 2 and 3 to actual line operation produces operating effects substantially the same as Embodiment 1.

As described hereinabove, the present invention makes it possible to maintain precise control of oxygen deposition on a steel sheet during decarburization annealing despite changes in surface roughness Ra of the steel sheet. Such precise control could not be achieved by prior art methods of monitoring and/or adjusting atmospheric gas or sheet temperature in an annealing furnace during decarburization annealing. Therefore, oxygen deposition on the steel sheet and, hence, the vitreous film produced during final annealing are held constant in the longitudinal direction thereof. Consequently, magnetic characteristics of an anisotropic electromagnetic steel sheet as a final product remain uniform in the longitudinal direction of the steel sheet.

Although this invention has been described with reference to specific forms of apparatus and method steps, equivalent steps may be substituted, the sequence of steps of the method may be varied, and certain steps may be used independently of others. Further, various other control steps may be included, all without departing from the spirit and the scope of the invention, which is defined in the appended claims.

What is claimed is:

1. A method for controlling oxygen deposition on a steel sheet during decarburization annealing wherein electrolytic degreasing is performed before decarburization annealing, and oxygen deposition onto said steel sheets is measured after said decarburization annealing comprising maintaining said oxygen deposition at a substantially constant value by controlling the electrolytic electricity density during electrolytic degreasing.

2. A method according to claim 1 wherein said controlling comprises:

determining an initial set value Is of the electrolytic electricity density during said electrolytic degreasing corresponding to a particular position in the longitudinal direction of said steel sheet to be processed from rolling conditions affecting the surface roughness Ra of said steel sheet in a cold rolling step prior to decarburization annealing of said steel sheet;

determining an electrolytic electricity density correction value ΔIs by measuring an actual value of the oxygen deposition continuously measured by an oxygen deposition detector, while tracking said steel sheet under treatment during said electrolytic degreasing before decarburization annealing, determining a corrected set value I by addition of ΔIs to said initial set value Is; and adjusting the electrolytic electricity density during electrolytic degreasing to said corrected set value I.

3. The method defined in claim 2 wherein said rolling conditions are selected from the group consisting of rolling speed of said steel sheet, the type of rolling oil applied during rolling, the type of rolling roll(s), the type of steel sheet, the thickness of the steel sheet, rolling length, sheet width and combinations thereof.

4. A method according to claim 1 wherein said controlling comprises:

determining the surface roughness Ra of said steel sheet at a particular position in the longitudinal direction from rolling conditions which affect the surface roughness Ra in a cold rolling step prior to decarburization annealing of said steel sheet; and setting an electrolytic electricity density corresponding to the determined surface roughness Ra of said steel sheet at said particular position in the longitudinal direction of said steel sheet.

5. The method defined in claim 4 wherein said rolling conditions are selected from the group consisting of rolling speed of said steel sheet, the type of rolling oil applied during rolling, the type of rolling roll(s), the type of steel sheet, the thickness of the steel sheet, rolling length, sheet width and combinations thereof.

6. A method according to claim 1 wherein said controlling comprises:

determining the surface roughness Ra of said steel sheet at a particular position in the longitudinal direction with a surface roughness meter prior to decarburization annealing of said steel sheet; and setting the electrolytic electricity density corresponding to the determined surface roughness Ra of said steel sheet at said particular position in the longitudinal direction of said steel sheet.

7. A method for controlling deposition of oxygen onto a steel sheet during decarburization annealing comprising:

cold rolling the steel sheet; and degreasing the cold rolled steel sheet with an electrolytic cleaner, wherein the current density of the electrolytic cleaner is varied to maintain the amount of oxygen deposited onto the cold rolled steel sheet at a constant value, the amount of oxygen deposited onto the cold rolled steel sheet being determined subsequent to both degreasing and decarburization.

8. The method defined in claim 7 wherein varying the current density includes:

determining an initial set value Is of said current density of said electrolytic cleaner corresponding to a particular position in a longitudinal direction of said steel sheet to be processed from rolling conditions in a cold rolling step prior to decarburization annealing of said steel sheet affecting the surface roughness Ra of said steel sheet;

determining a current density correction value ΔIs by measuring continuously, subsequent to both degreasing and decarburization annealing, the amount of oxygen deposited onto the cold rolled steel sheet by an oxygen deposition detector;

determining a corrected set value I by addition of ΔIs to said initial set value Is; and adjusting the current density of said electrolytic cleaner to said corrected set value I.

9. The method defined in claim 8 wherein said rolling conditions are selected from the group consisting of rolling speed of said steel sheet, the type of rolling oil applied during rolling, the type of rolling roll(s), the type of steel sheet, the thickness of the steel sheet, rolling length, sheet width and combinations thereof.

10. The method according to claim 7 wherein varying the current density comprises:

determining the surface roughness Ra of said steel sheet at a particular position in the longitudinal direction from rolling conditions affecting the surface roughness Ra in a cold rolling step prior to decarburization annealing of said steel sheet; and setting a current density of the electrolytic cleaner corresponding to the determined surface roughness Ra of said steel sheet at said particular position in the longitudinal direction of said steel sheet.

11. The method defined in claim 10 wherein said rolling conditions are selected from the group consisting of rolling speed of said steel sheet, the type of rolling oil applied during rolling, the type of rolling roll(s), the type of steel sheet, the thickness of the steel sheet, rolling length, sheet width and combinations thereof.

12. The method according to claim 7 wherein said varying comprises:

determining the surface roughness Ra of said steel sheet at a particular position in a longitudinal direction with a surface roughness meter prior to decarburization annealing of said steel sheet; and setting the current density of the electrolytic cleaner corresponding to the determined surface roughness Ra of said steel sheet at said particular position in the longitudinal direction of said steel sheet.

* * * * *

UNITED STATES PATENT AND TRADEMARK OFFICE

CERTIFICATE OF CORRECTION

PATENT NO. : 5,472,520

DATED : December 5, 1995

INVENTOR(S) : Yoshinori Anabuki, et al

It is certified that error appears in the above-indentified patent and that said Letters Patent is hereby corrected as shown below:

Column 1, line 37, please change "4-337003" to --4-337033--.

Signed and Sealed this

Thirtieth Day of April, 1996

Bruce Lehman

*Attest:*

BRUCE LEHMAN

*Attesting Officer*

*Commissioner of Patents and Trademarks*